US008104733B2

(12) United States Patent
Skolnik

(10) Patent No.: US 8,104,733 B2
(45) Date of Patent: Jan. 31, 2012

(54) BOOK REST

(76) Inventor: Adrienne Skolnik, Aurora, CO (US)

( * ) Notice: Subject to any disclaimer, the term of this patent is extended or adjusted under 35 U.S.C. 154(b) by 485 days.

(21) Appl. No.: 12/252,180

(22) Filed: Oct. 15, 2008

(65) Prior Publication Data

US 2011/0101195 A1 May 5, 2011

Related U.S. Application Data

(60) Provisional application No. 60/999,656, filed on Oct. 19, 2007.

(51) Int. Cl.
*A47B 19/00* (2006.01)

(52) U.S. Cl. ..... 248/441.1; 248/444; 248/451; 248/460

(58) Field of Classification Search ..... 248/441.1, 248/444, 447, 460, 461, 463
See application file for complete search history.

(56) References Cited

U.S. PATENT DOCUMENTS 3,097,444 A * 7/1963 Steiner ..... 248/454
3,848,944 A * 11/1974 Gilmer, Jr. ..... 312/314
4,607,817 A * 8/1986 Aquino ..... 248/459
4,962,859 A * 10/1990 Kump ..... 211/50
5,301,800 A * 4/1994 Kenney ..... 206/449
5,542,551 A * 8/1996 Smith ..... 211/50
5,813,354 A * 9/1998 Scott ..... 108/44
6,092,673 A * 7/2000 Woolnough et al. ..... 211/50
6,270,049 B1 * 8/2001 Olvey ..... 248/441.1
6,971,621 B2 * 12/2005 Gaines ..... 248/447
7,334,768 B1 * 2/2008 Lum ..... 248/444
2004/0135052 A1 * 7/2004 Hecker ..... 248/459
2005/0051504 A1 * 3/2005 Moss et al. ..... 211/149
2006/0144884 A1 * 7/2006 Abbate ..... 224/585
2006/0289611 A1 * 12/2006 Yeh ..... 229/67.1

* cited by examiner

*Primary Examiner* — Terrell McKinnon
*Assistant Examiner* — Eret McNichols
(74) *Attorney, Agent, or Firm* — Kyle W. Rost

(57) ABSTRACT

A collapsible book rest is formed of panels that are variously interconnected by means chosen from hinges, tracks, slots, ledges, and the like that allow the panels to be deployed to form a first, supporting structure. The panels include a rear panel, front panel, top panel, bottom panel, left panel and right panel. A slidable stabilizer panel is extendable and retractable from the bottom panel. The front and bottom panels of the supporting structure define a recess that accommodates an individual's abdominal shape, and the slide stabilizer defines a similarly shaped front edge. The book rest is collapsed by variously disconnecting and folding over the panels.

10 Claims, 21 Drawing Sheets

BOOK REST

This patent application claims the benefit of U.S. provisional patent application Ser. No. 60/999,656 filed Oct. 19, 2007, the entire disclosure of which is incorporated by reference herein.

FIELD OF THE INVENTION

A support is provided for positioning an article at a specific height and/or angle. More specifically, an improved rest for reading materials is provided for use by the infirmed or handicapped, for example. In addition, one embodiment of the present invention is capable of being used as a computer table, writing table and table top podium. Some embodiments of the present invention are collapsible to facilitate storage and transportation of the book rest.

BACKGROUND OF THE INVENTION

Many ill or disabled individuals find it difficult to read in a prone and/or sitting position. For example, the infirmed are often so weak that the mere task of lifting and holding a book at an optimum position for reading is very difficult. Some individuals with chronic illnesses have difficulty supporting a book of any size. In the past, individuals addressed this problem by using a pillow or blanket as a book rest. However, pillows do not provide adequate and consistent support, do not position the book at the optimum height and/or angle, are uncomfortable, i.e., add heat and weight to an individual's legs. Some book rests of the prior art require a table to rest on to function properly or to elevate the resting book, are not portable, and/or do not position the book at the ideal reading height/angle. For example, the PortaBook laptop stand is designed to receive a book on a selectively adjustable surface. This product, however, does not position the book at an acceptable height for reading wherein additional mechanisms such as a table or a pillow are needed to elevate the book at an optimum height.

Thus, it is a long felt need to provide a book rest that is light, transportable, easy to use, and that positions the reading material at an optimum height and angle. The following disclosure describes an improved book rest, which in some embodiments is collapsible to facilitate transportation and/or storage thereof.

SUMMARY OF THE INVENTION

It is one aspect of the present invention to provide a rest for a book. One embodiment of the present invention includes a plurality of interconnected panels that form a supporting structure. A book is placed on a top surface of the book rest and is held in place by a plurality of ridges that engage the lower edge of the book. The ridges may be selectively interconnected to the top surface to facilitate accommodation of books or reading material of various shapes and sizes. For example, in one embodiment the ridges are selectively interconnected to the top surface via magnets, hook and loop fasteners, snaps, studs, and slots, etc. Preferably the ridges are rigid, but could be formed of a compliant material. A portion of the book adjacent to the upper edge thereof is supported by an upper edge of the book rest's rear panel. Positioning the book on the top surface and the upper edge of the rear surface thus locates the book at a predetermined angle. The term "book" as used herein shall mean any reading material or personal electronic device.

Embodiments of the present invention may further include page holders to help maintain the book in a desired position of use. The page holders of one embodiment of the present invention are spring-biased preferably employing torsion springs. One skilled in the art will appreciate however, that other mechanisms may be used, such as weighted clips, magnetic clips and/or a bar or other device that is positioned across the entire reading surface.

It is another aspect of the present invention to provide a book rest that can accommodate books, computers or other electronic devices of larger sizes. More specifically, embodiments of the present invention are dual use such that oversized books, writing materials or lap top computers rest on a secondary reading surface.

It is yet another aspect of the present invention to provide a book rest that is collapsible and/or easily transportable. That is, embodiments of the present invention are made of lightweight materials and, thus, when in use, do not add a great amount of weight to the legs of a user. Furthermore, other embodiments of the present invention are collapsible to facilitate storage and/or transportation of the book rest in a briefcase or purse, for example.

It is still yet another aspect of the present invention to provide a book rest that positions a book in an optimum reading location. More specifically, often those individuals with vision problems who perhaps wear bifocals, require reading materials to be placed at a specific height and/or angle. Embodiments of the present invention include panels that elevate the book, wherein additional means, for example, a table is not required. One of skill in the art will appreciate that the book rest as contemplated herein may include selective height adjustments, such as telescoping, folding or expandable legs. It is another aspect of the invention to provide a book rest that accommodates those confined to wheelchairs. More specifically, book rests of some embodiments of the present invention include mechanisms for receiving straps, or built in straps for interconnecting to a wheel chair. Alternatively, the book rest may include apertures for receiving bungee cords or other devices for interconnection to a wheel chair.

It is another aspect of the present invention to provide a book rest that is comfortable to use. More specifically, a generous book supporting top surface is employed for receiving a book and/or a user's hands. Further, portions of the book rest may be padded to increase the comfort level of the user.

It is yet another aspect of the present invention to provide additional integrated features onto or adapted to be received on the book rest. More specifically, one embodiment of the present invention includes a power source, such as at least one battery, a power cord, or solar panel that provides electricity to a reading lamp, a music device, a dictation device, a fan, a cell phone, personal data assistant, etc. The light contemplated may be directly integrated into the book rest or may be clipped onto a portion of the book rest. One skilled in the art will appreciate that such lights may be made of light emitting diodes, i.e., small, lightweight, and long lasting. Traditional light sources, however, that employ light bulbs may be used as well. Also, it is envisioned that an electronic device may be incorporated directly into one of the panels or surfaces of the book rest. For example, an iPod®, recording device, PDA, cell phone, video screen for display of information, a clock, etc., may be incorporated directly into the book rest. It follows that other items such as magnifying glass associated with a selectively articulating arm may be incorporated into the book rest to aid those with poor eyesight.

It is another aspect of the present invention to provide a book rest that includes auxiliary storage areas. Some embodiments of the present invention include pockets or holders for drinks, snacks, magnifying lenses, or pens, etc. The storage areas may be comprised at least partially of stretchable material such that when the items are removed, those portions would resiliently deflect to decrease the envelope of the book rest. Other embodiments of the present invention are at least partially hollow or contain cavities for receipt of items.

It is another aspect of the present invention to provide a book rest that can be integrated into tables or trays. More specifically, upon review of the drawings and detailed description provided below, one of skill in the art will appreciate that some or all of the features of the book rests described may be integrated into a table. It is envisioned that such features be recessed into a table, for example, such that one could deploy the book rest to create a podium, for example. Other features of the present invention may be integrated into a tray table of a passenger jet or an adjustable hospital bed table or bed tray table such that when not employed, the book rest would lie flat with respect to the remaining portions of the table.

Thus an improved book rest, holder and support that is lightweight, portable and which raises a book to an optimum reading level angle to accommodate those with vision problems is provided. The device as described herein does not require a table for support and may be placed directly on an individual's legs or thighs while in bed, in a chair, or in a wheelchair. The device as described herein is comfortable, eliminates the need to hold a book for long periods of time, eases eye strain, is portable, facilitates storage, is multi-positionable and adjustable and accommodates an individual's abdomen shape. Other advantages will be apparent to those of skill in the art.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects and advantages of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
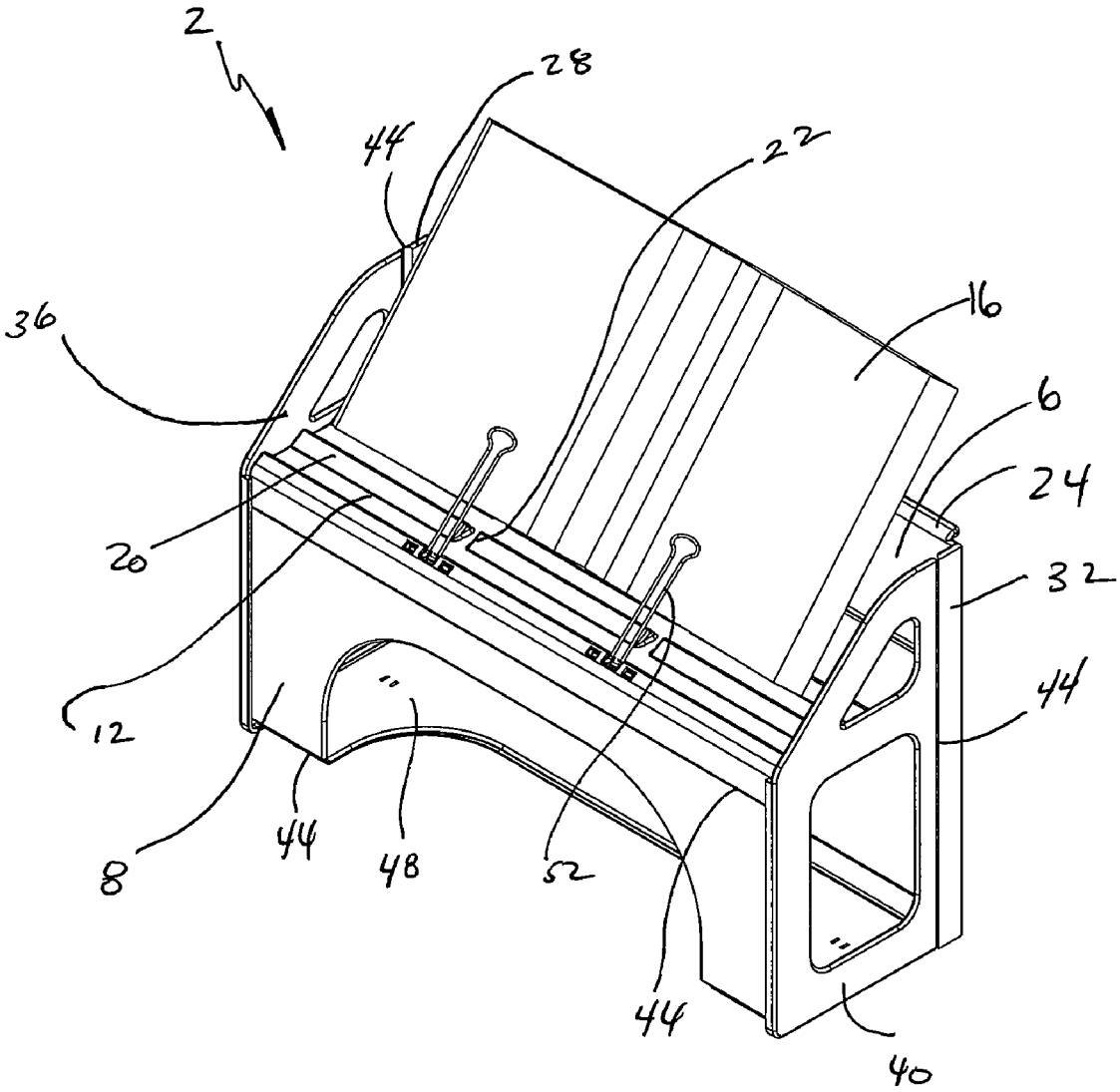
FIG. 1 is a perspective view of a selectively collapsible embodiment of the present invention.

To assist in the understanding of the present invention the following list of components and associated numbering found in the drawings is provided below:

| # | Component |
|---|---|
| 2 | Book rest |
| 6 | Rear panel |
| 8 | Front panel |
| 12 | Top panel |
| 16 | Book |
| 20 | Ridge |
| 22 | Seat |
| 24 | Protrusion |
| 28 | Left wall |
| 32 | Right wall |
| 36 | Left panel |
| 40 | Right panel |
| 44 | Hinge |
| 48 | Bottom panel |
| 52 | Page holder |
| 56 | Stabilizer |
| 60 | Slot |
| 64 | Opening |
| 68 | Track |
| 72 | Ledge |
| 76 | Fastener |
| 76M | Male fastener |
| 76F | Female fastener |
| 78 | Stop |
| 80 | Edge |
| 84 | Tabs |
| 88 | Aperture |
| 92 | Side opening |
| 93 | Large book |
| 94 | Computer |
| 96 | Raised member |
| 100 | Recess |
| 104 | Grasping member |
| 108 | Raised member |
| 112 | Lip |
| 116 | Slot |
| 120 | Hinge |
| 130 | Support |
| 134 | Edge |
| 138 | Side wall |
| 142 | Top surface |
| 146 | Rib |
| 150 | Ledge |
| 154 | Palm rest |
| 158 | Front surface |
| 162 | Recess |
| 166 | Base |
| 170 | Handle |
| 174 | Storage area |
| 178 | Rear surface |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-15, a book rest 2 of one embodiment of the present invention is shown. The book rest 2 includes a rear panel 6 that is spaced from a front panel 8. A top panel 12 is also included that is adapted to receive a book 16. In order to maintain the book 16 in a preferred orientation, at least one ridge 20 is employed that are adapted to receive a lower edge of the book 16. A plurality of ridges 20 are preferably provided such that by moving the lower edge of the book 16 to engage different ridges 20 (or, alternatively, moving the ridge) the angle of the book 16 is selectively altered. The ridges 20 may be continuous across the top panel 12 but are preferably broken by page holder seats 22, i.e., non-continuous, which will be described in further detail below. The ridges 20 may be of any shape and as long as they function to maintain the book 16 in a preferred angle. Ridges may also be formed by recesses in the top panel 12 to decrease the envelope of the folded book rest 2. The top panel 12 may be made at least partially of a resilient material such that the weight of the book creates a stabilizing indentation. Further the top surface may have a roughened surface that frictionally supports a book. In operation, the book 16 rests on the top panel 12 and is supported by a ridge 20 and an upper edge of the rear panel 6. In some embodiments of the present invention, a protrusion 24 is provided that aids in using the book rest in a second position of use, which will be described in further detail below.

In order to maintain the pages of the book 16 in a desired position, some embodiments of the present invention include at least one page holder 52 that is incorporated into the top panel 12.

In one embodiment a left wall 28 and a right wall 32 extend from the rear panel 6. A left panel 36 is associated to the left wall 28 and a right panel 40 is associated to the right wall 32. One of skill in the art will appreciate that the left panel 36 and the right panel 40 may be associated directly to the rear panel 6. The panels are preferably operably interconnected to the walls via a hinge 44. Preferably, embodiments of the present invention employ a flexure bearing, i.e., a "living hinge" wherein a portion of material is provided of decreased thickness that allows the panels to rotate relative to the rear panel 6. One skilled in the art will appreciate, however, that the panels may be interconnected to the walls/rear panel 6 in other ways such as by piano hinges, pins, clasps, magnets, adhesives, hook & loop fasteners, strings, ball and socket type connectors, etc., without departing from the scope of the invention. The front panel 8 and a bottom panel 48 are also preferably interconnected by this type of hinge 44. Further, the front panel 8 and the top panel 12 also employs such a hinge 44 for operable interconnection. The bottom panel 48 is adapted to rest on a user's legs or on a table to function as a podium.

Figure 2:
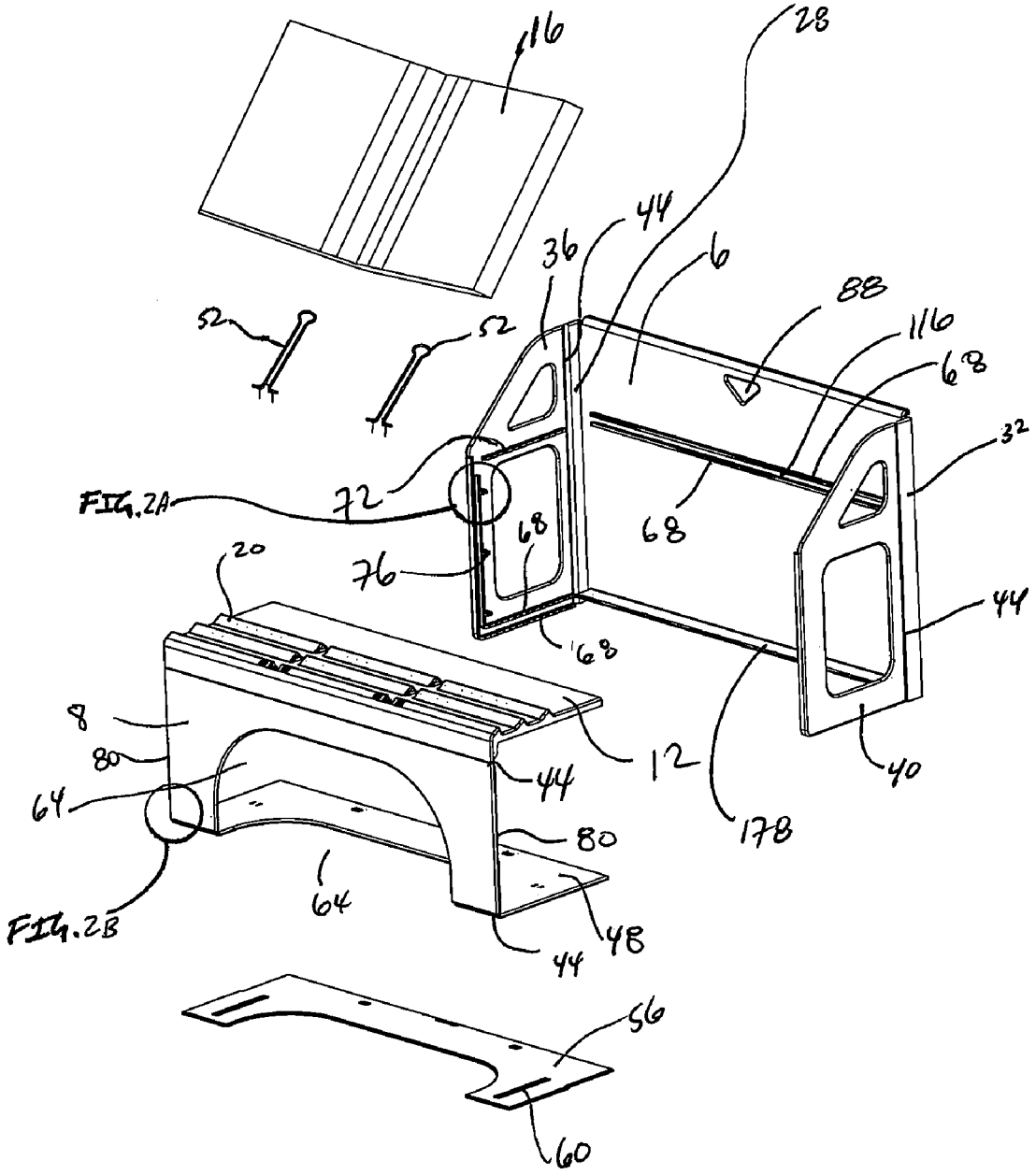
FIG. 2 is an exploded version of FIG. 1.
Figure 5:
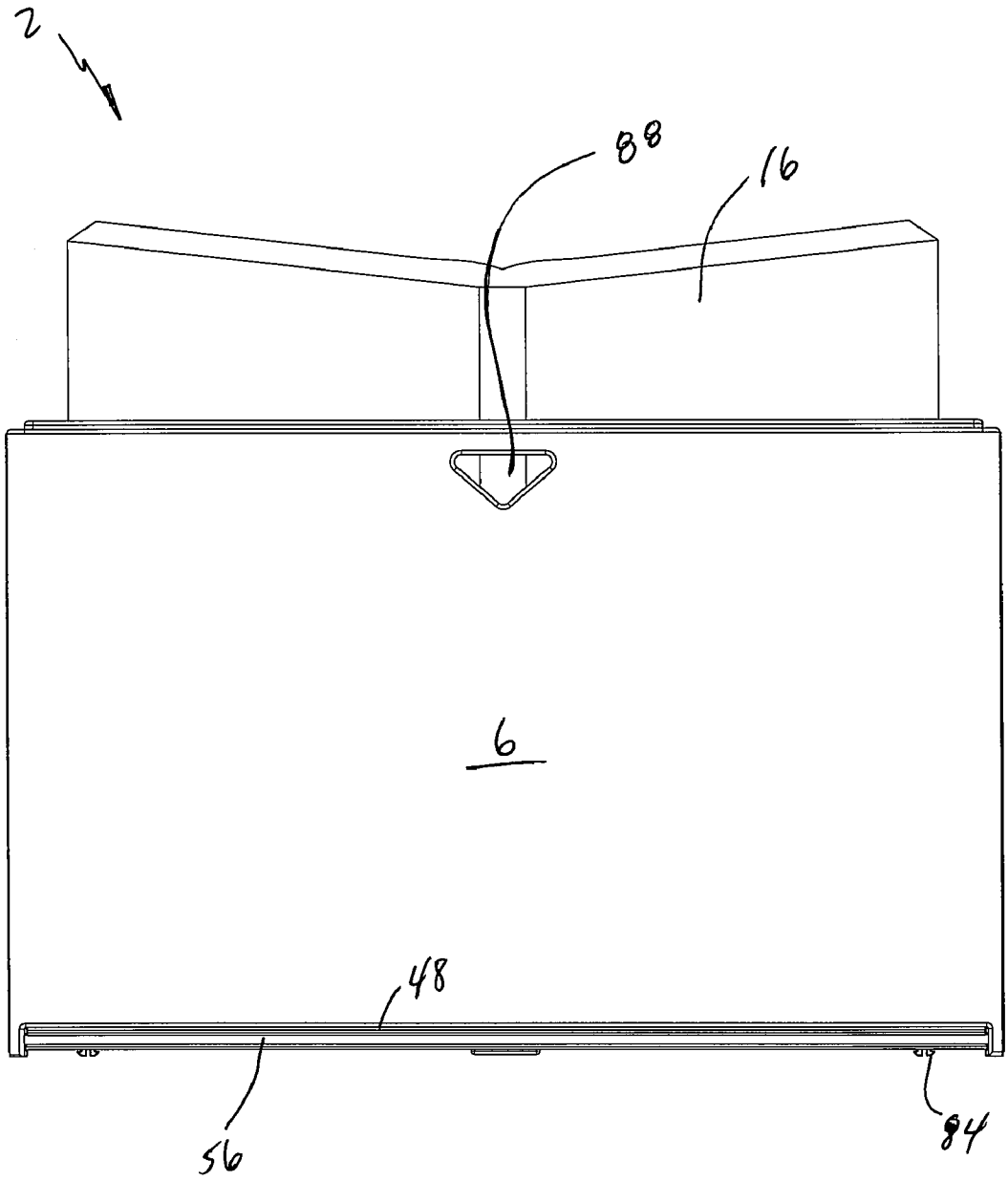
FIG. 5 is rear elevation view of FIG. 1.

Referring now specifically to FIG. 2, an exploded view of the book rest 2 of one embodiment of the invention is shown that includes a stabilizer 56 that is operably interconnected to the bottom panel 48 via a slot 60 that slidingly received by a tab (See FIGS. 5 and #84). The front panel 8 and the bottom panel 48 may also include an opening 64 to accommodate physiological differences between individuals. Preferably, the stabilizer 56 has a profile generally the same as the profile of the bottom panel 48 such that when the stabilizer 56 is in a first, retracted position of use its edges are generally flush with the edges of the bottom panel 48. The stabilizer is contoured such that when in the first, retracted position of use, at least a forward edge of the stabilizer is flush with a forward edge of the bottom panel at the recess. One of skill in the art will appreciate that the stabilizer 56 may be smaller or larger than the bottom panel 48. Further, the stabilizer 56 may include arms or other devices that selectively alter its shape. The stabilizer 56 may be telescopic having interlocking members to enable the user to selective alter its shape and/or degree of offset from the rear surface 6.

Also, in FIG. 2, a plurality of tracks 68 are shown. The tracks 68 receive edges of the bottom panel 48, front panel 8 and top panel 12 to secure those panels in a predetermined location when the book rest 2 is in use. The left panel wall 36 and right panel wall 40 also include at least one ledge 72 that maintains a bottom surface of the top panel 12 in the proper position of use. Although the track 68 and ledges 72 are shown to be continuous, they may be formed by a series of discrete members.

Figure 2A:
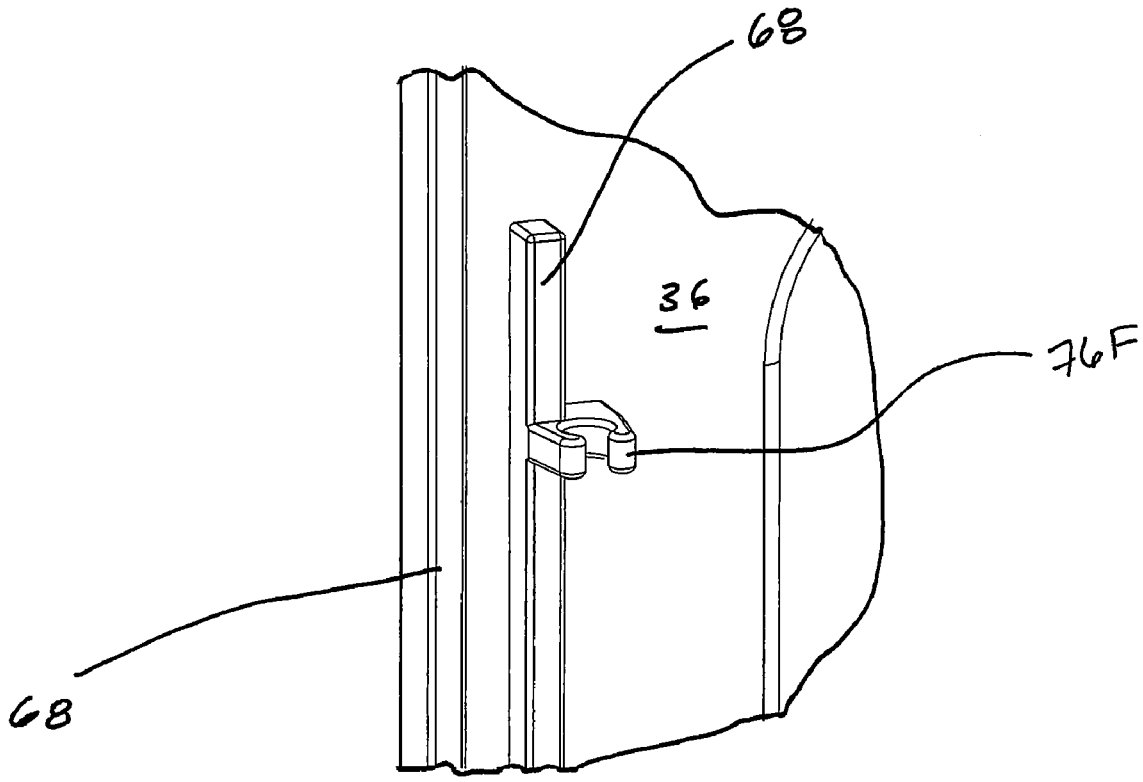
FIG. 2A is a detailed view of FIG. 2.
Figure 2B:
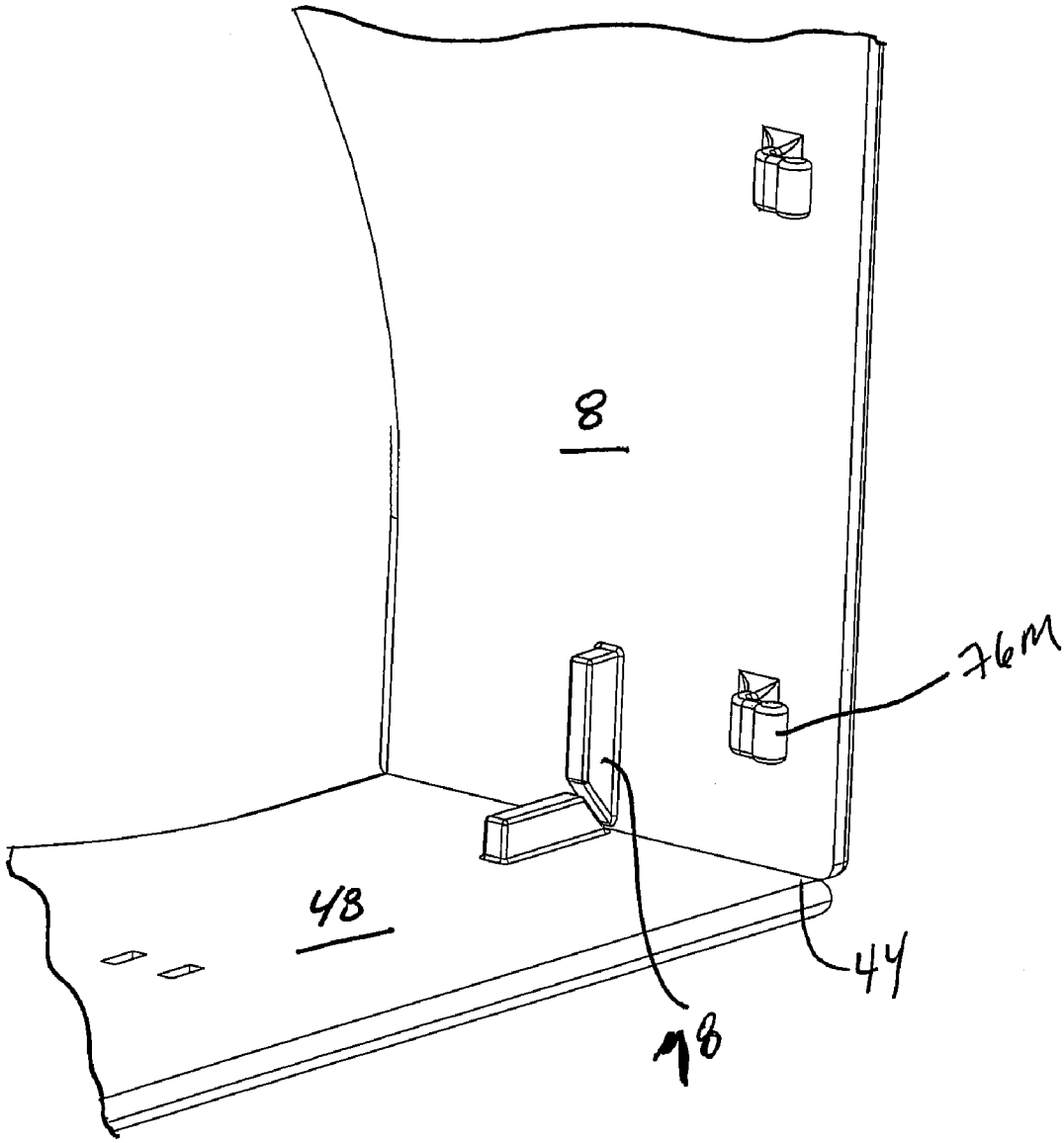
FIG. 2B is a rotated view of FIG. 2.

Referring now to FIGS. 2A and 2B, in order to maintain the left panel 36 and the right panel 40 in the proper configuration of use, a plurality of fasteners 76 are employed adjacent to an edge of each of the left panel 36 and the right panel 40. The fasteners are preferably deformable sleeve clips having a male portion 76M and a female portion 76F. The female portions 76F receive and secure the male portions 76M, which are located adjacent to an edge 80 of the front panel 8. The female portions 76 are adapted to resiliently deflect to receive the male portions 80 to selectively interconnect the left panel 36 and the right panel 40 to the front panel 8. One of skill in the art will appreciate that the left panel 36, the right panel 40 and front panel 8 may employ other devices, such as magnets, snaps, pins, hook & loop materials, adhesives, etc. to maintain the left panel 36 and right panel 40 in the proper location relative to the front panel. The lower edge of the left panel 36 and the right panel 40 may also include such interconnection means. The front panel 8 and the bottom panel 48 may also include stops 78 that prevent over flexing the hinge 44.

Figure 3:
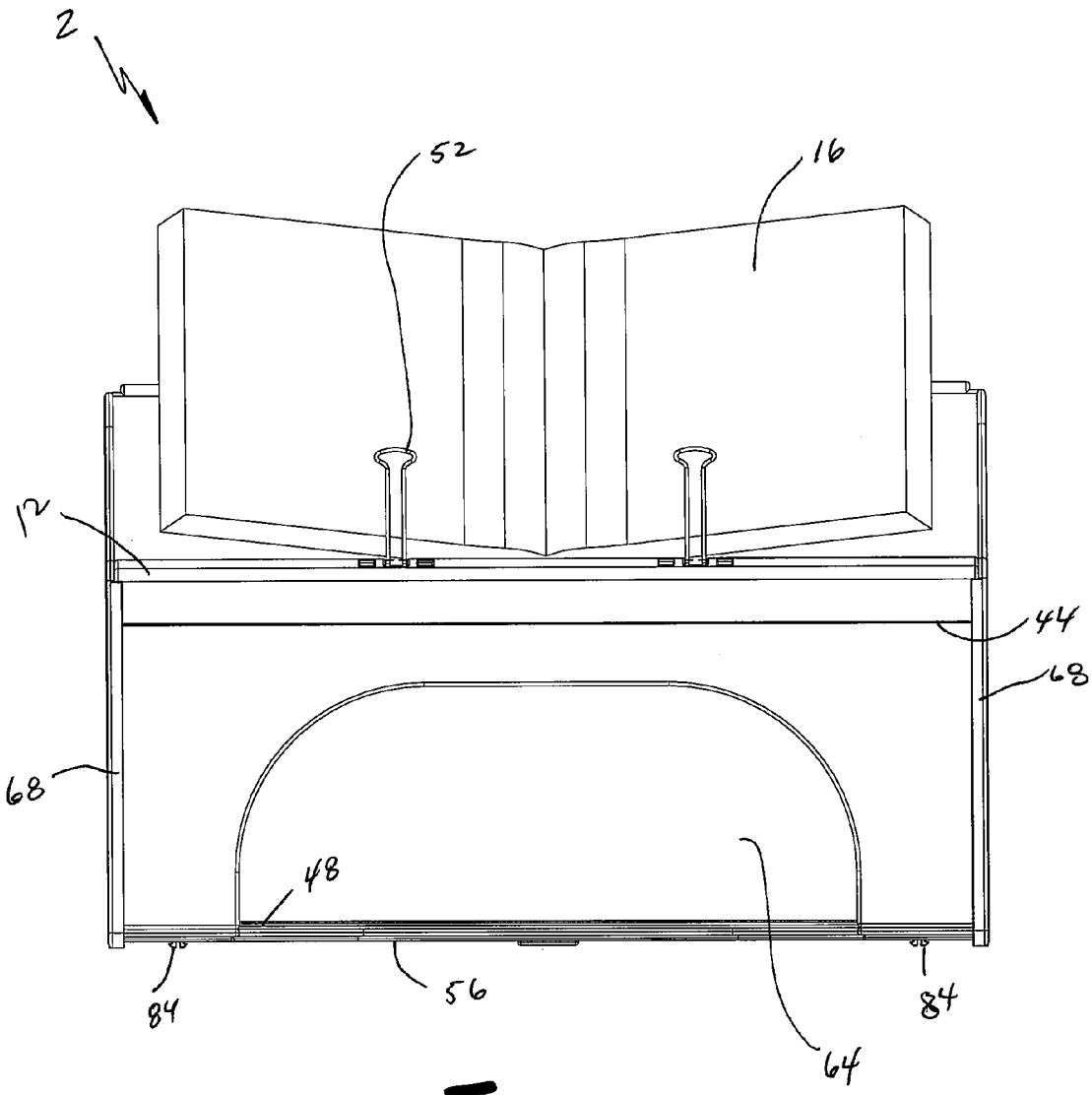
FIG. 3 is a front elevation view of FIG. 1.
Figure 4:
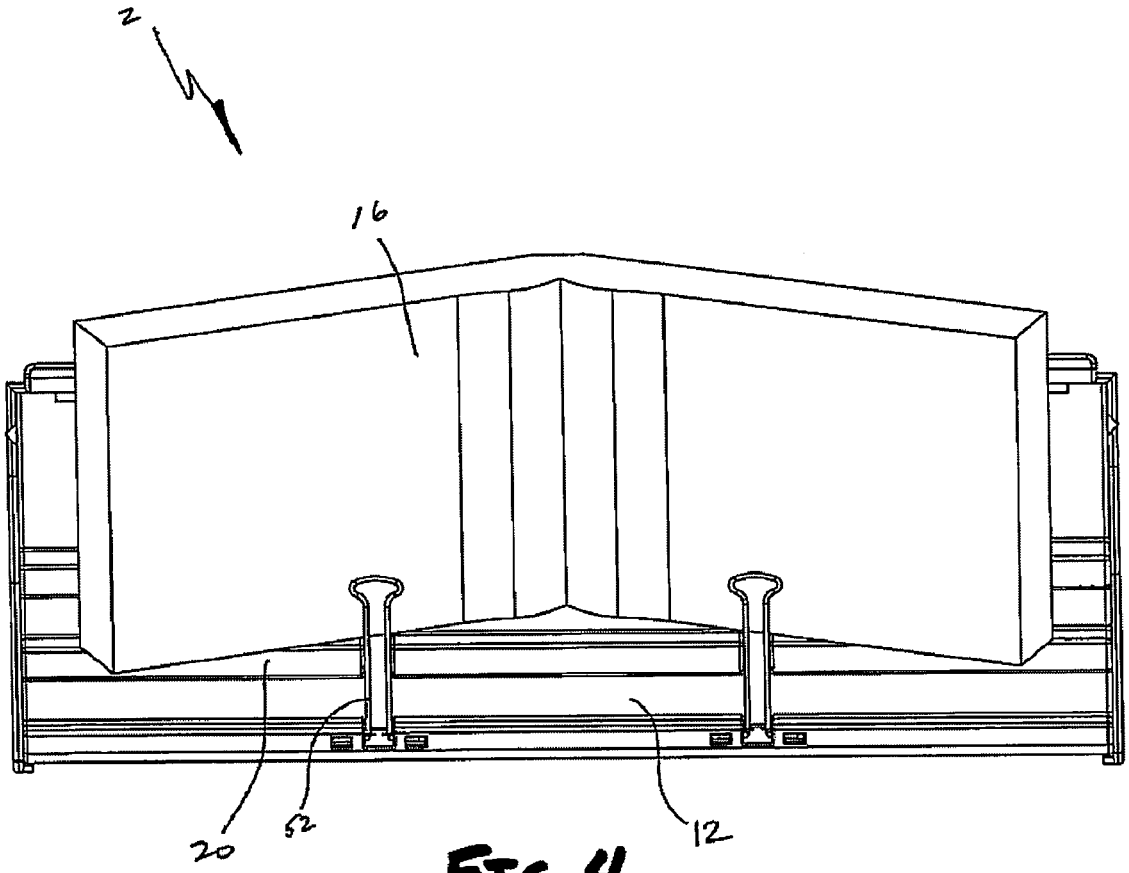
FIG. 4 is a top plan view of FIG. 1.

Referring now to FIG. 3, a front elevation view of the book rest 2 of one embodiment of the present invention is shown. Here, the book 16 is situated on the top surface 12 wherein the page holders 52 are shown maintaining the book 16 in an open position. The stabilizer 56 is shown in a first, retracted position of use wherein tabs 84 maintain the stabilizer 56 against the bottom panel 48 while allowing the stabilizer 56 to move relative thereto.

Referring now to FIG. 5, a rear elevation view of one embodiment of the present invention in shown. Here, the stabilizer 56 is shown positioned adjacent to the bottom panel 48 and in a sliding relationship therewith. The back panel 6 includes an aperture 88 that is designed to facilitate transportation of the folded or unfolded book rest 2. In addition, the aperture 88 may be used to receive a hook, for example, to fasten the book rest 2 to a wall or other vertical or semi-vertical surface.

Figure 6:
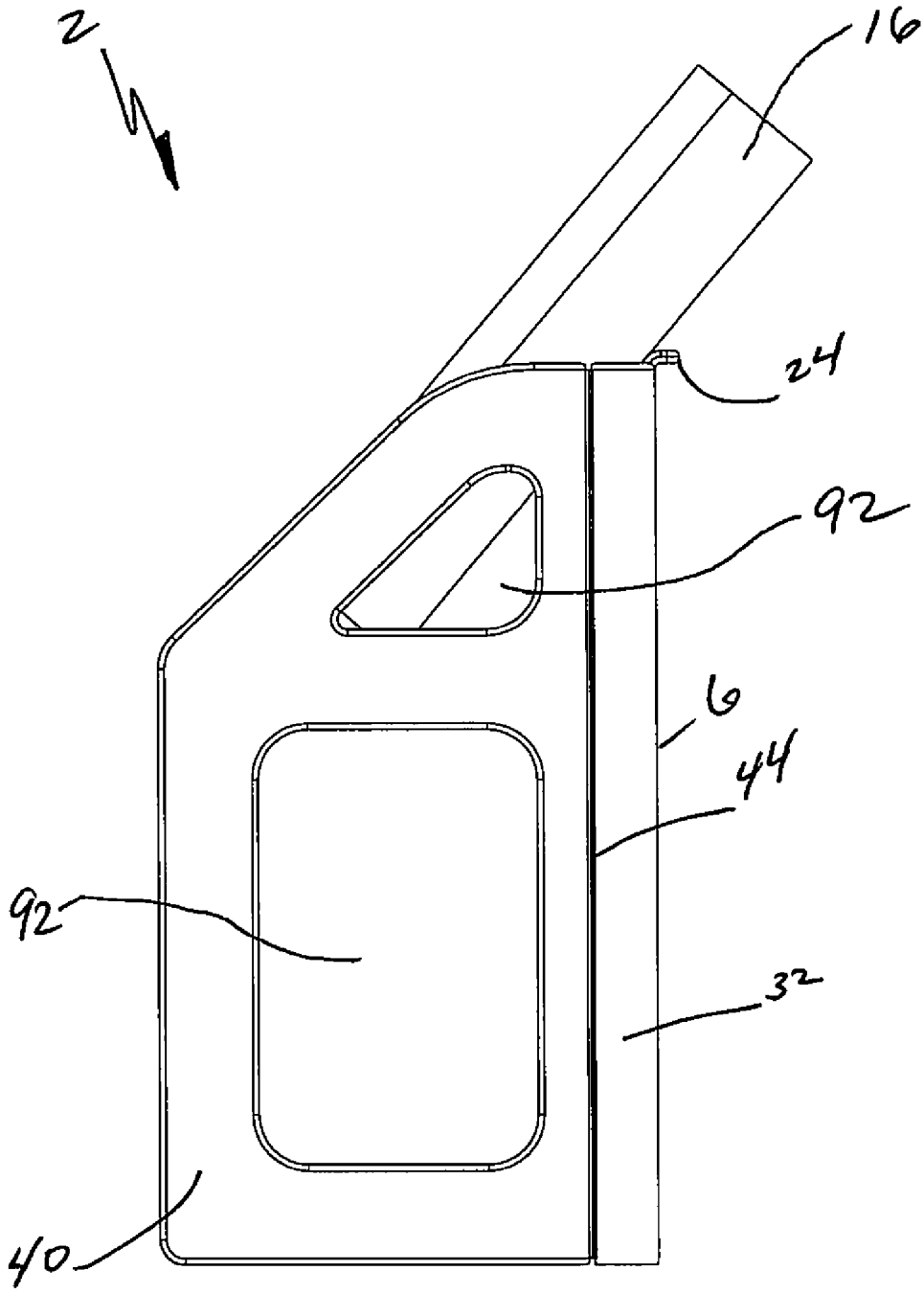
FIG. 6 is a side elevation view of FIG. 1.

Referring now to FIG. 6, the book 16 is shown resting on an upper edge of the back panel 6. Some embodiments of the present invention include a protrusion 24, which will be described in detail below. In those embodiments, the book 16 will rest on the protrusion 24 instead of an upper edge of the rear panel 6. A plurality of side openings 92 are provided that decrease the weight of the book rest 2 and increase ventilation therethrough. The side openings 92 may be of any shape or size and also may receive a bungee cord or other device to help fasten the book rest 2 to an individual or to a wheel chair, for example. The side openings 92 also provide additional locations to help move and position the book rest 2.

Review of FIG. 6 will also succinctly show the hinge 44. As mentioned above, the hinge 44 is preferably a living hinge wherein the right wall 32 and the right panel 40 are made of the same component (same is true for the left wall and left panel, which are not shown). The hinge 44 is a thinned portion of parent material that allows for the right panel 40 to rotate relative to the right wall 32. Again, one skilled in the art will appreciate that various other ways may be employed to interconnect the panels to the walls. It will also be appreciated that the rear panel 6, the right wall 32, left wall, right panel 40 and left panel may be made of a single component to simplify construction.

Figure 7:
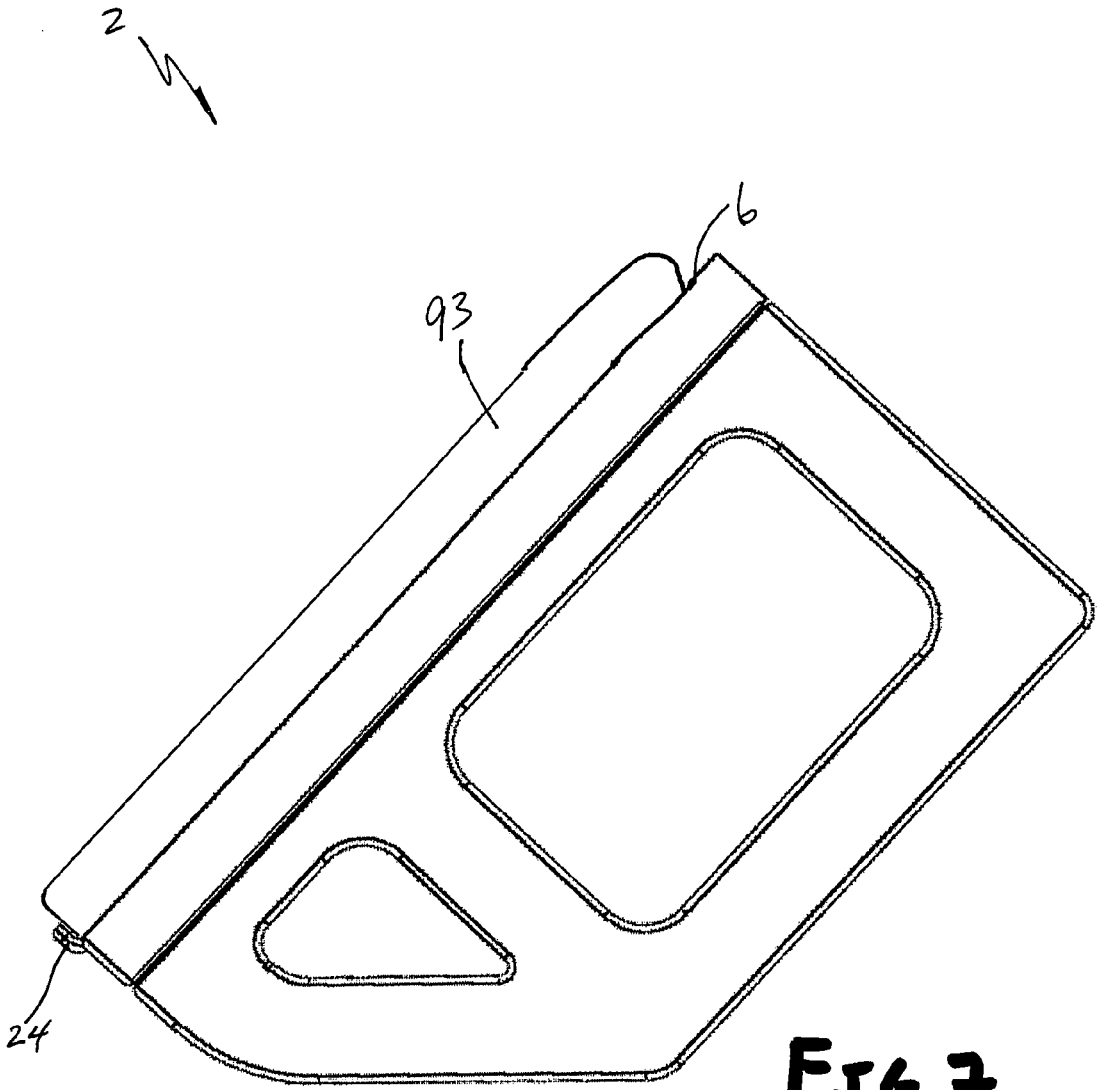
FIG. 7 is a view of the book rest shown in FIG. 1 in an inclined position that is adapted to receive a large book.
Figure 7A:
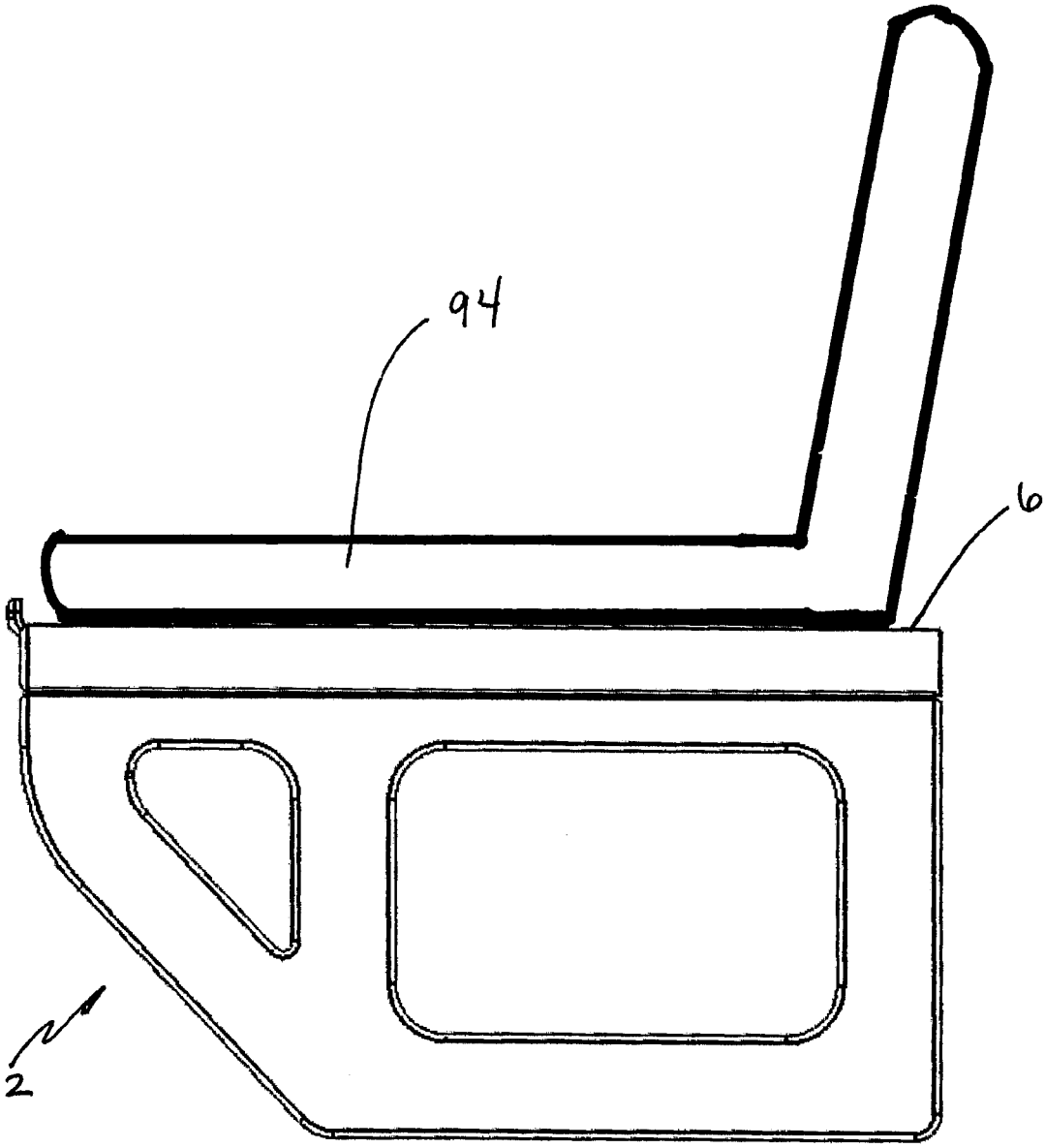
FIG. 7A is a view of the book rest shown in FIG. 1 in a horizontal position that is adapted to receive a laptop computer.

Referring now to FIGS. 7A and 7B, one embodiment of the present invention is shown in an inclined, second position of use. More specifically, the rear panel 6 is adapted to receive other items, such as a large book 93. In this orientation, the protrusion 24 functions to maintain the book 93 on the rear panel 6. Although the protrusion 24 is shown extending across the entire rear panel 6, one skilled in the art will appreciate that the protrusion 24 may be comprised of many small protrusions without departing from the scope of the invention. A protrusion of this type or one similar thereto may be employed on the second one-piece embodiment of the present invention that will be described in further detail below. The book rest 2 may be further rotated to provide a surface for a laptop computer 94 or writing materials.

Figure 8:
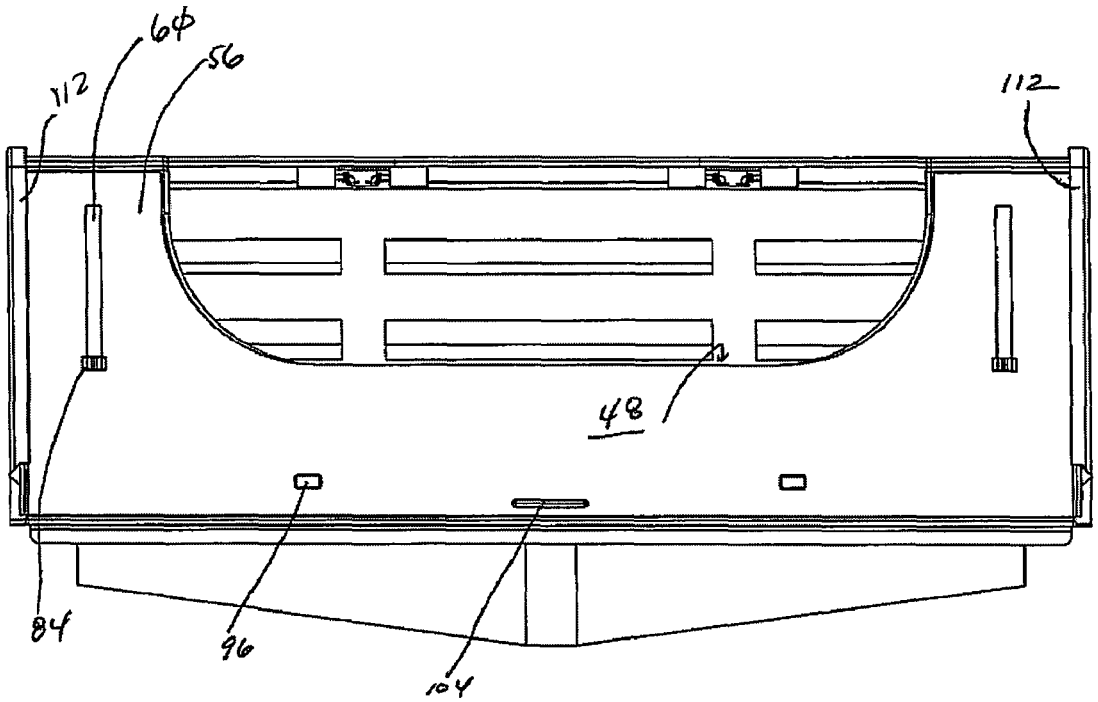
FIG. 8 is a bottom plan view of FIG. 1.
Figure 9:
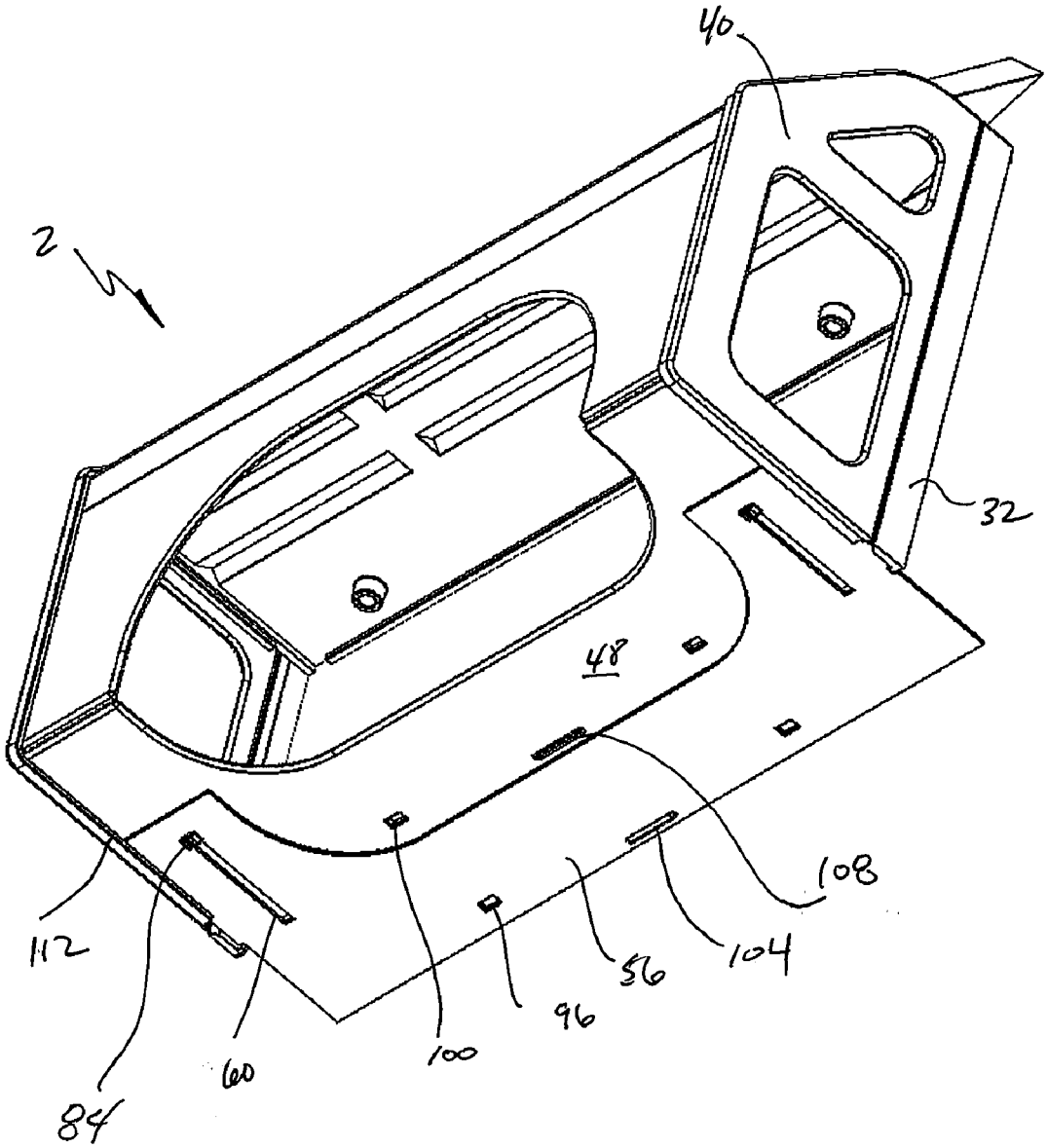
FIG. 9 is a bottom perspective view of the book rest of FIG. 1 wherein a stabilizer has been extended.
Figure 10:
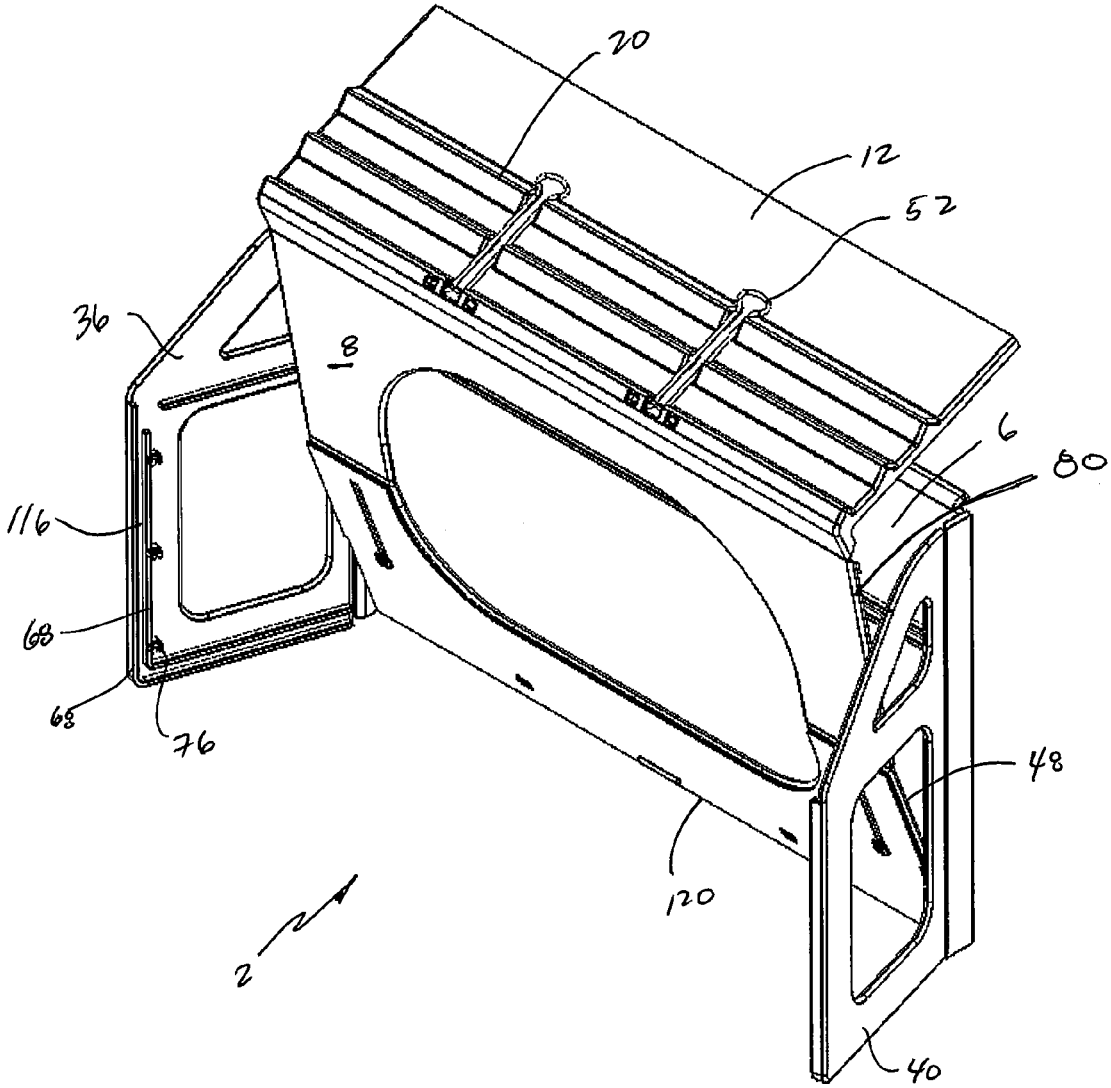
FIG. 10 is a view of the book rest of FIG. 1 wherein left and right panels have been transitioned outwardly to allow folding of the book rest.
Figure 11:
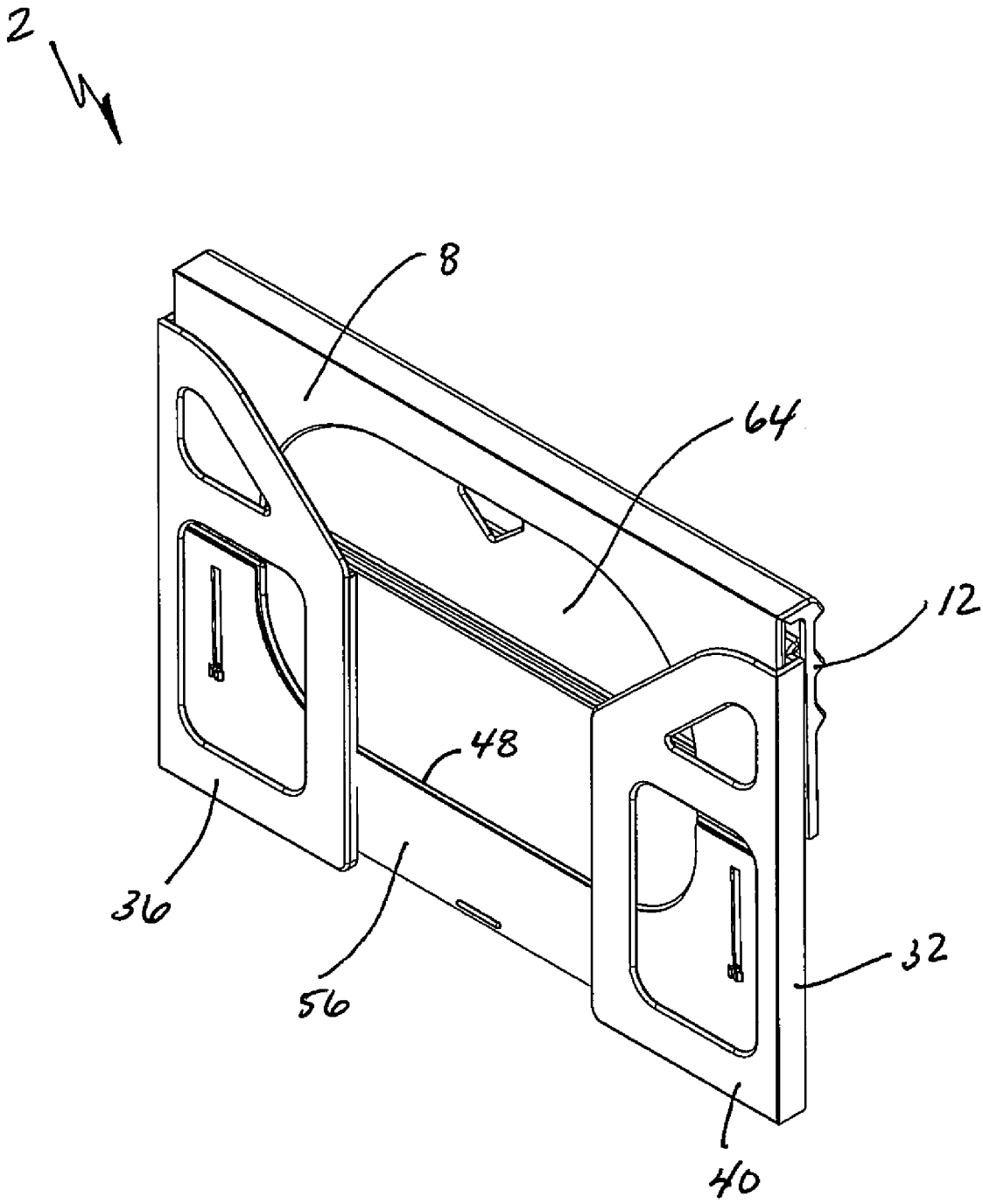
FIG. 11 is a perspective view of a folded book rest.
Figure 12:
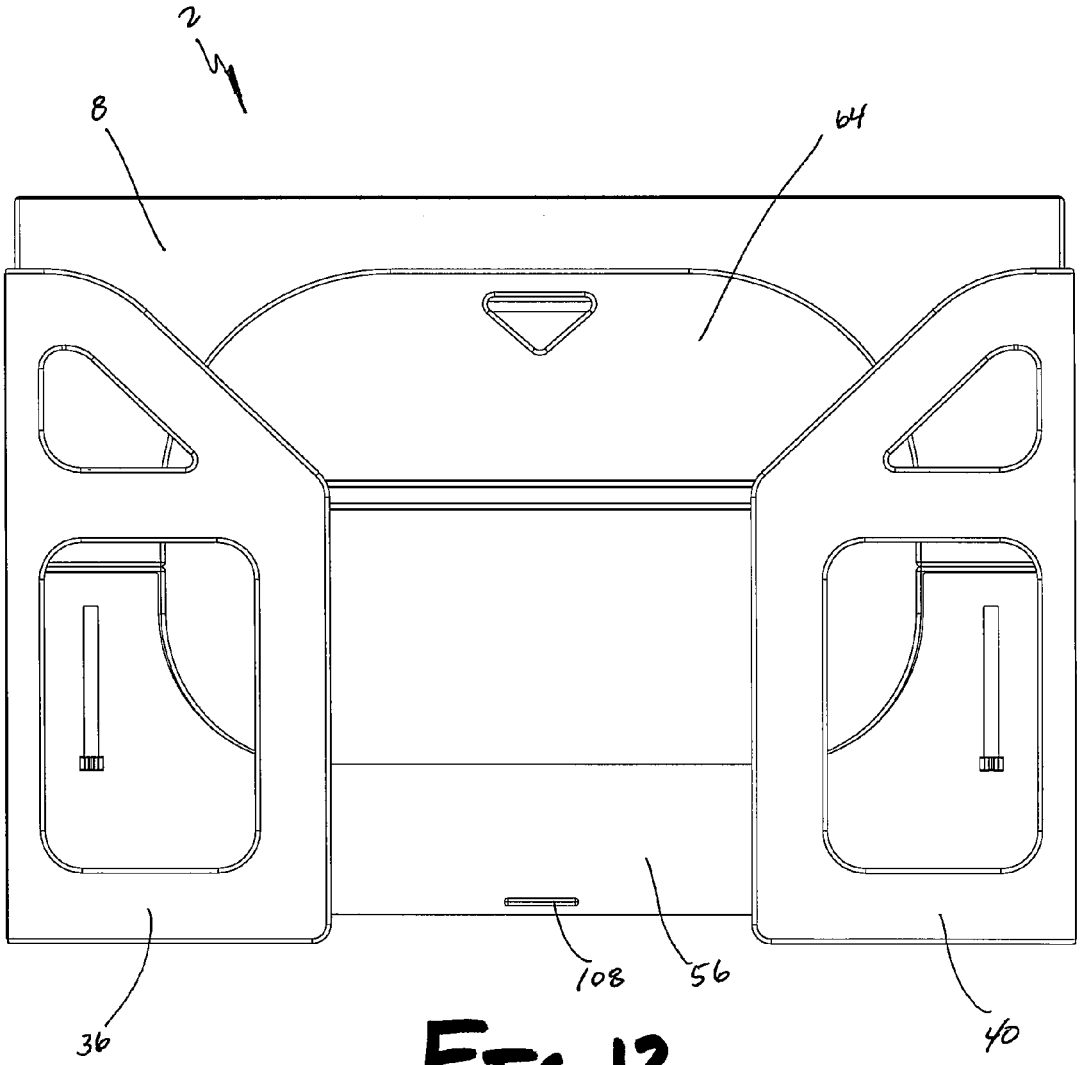
FIG. 12 is a front elevation view of FIG. 11.
Figure 13:
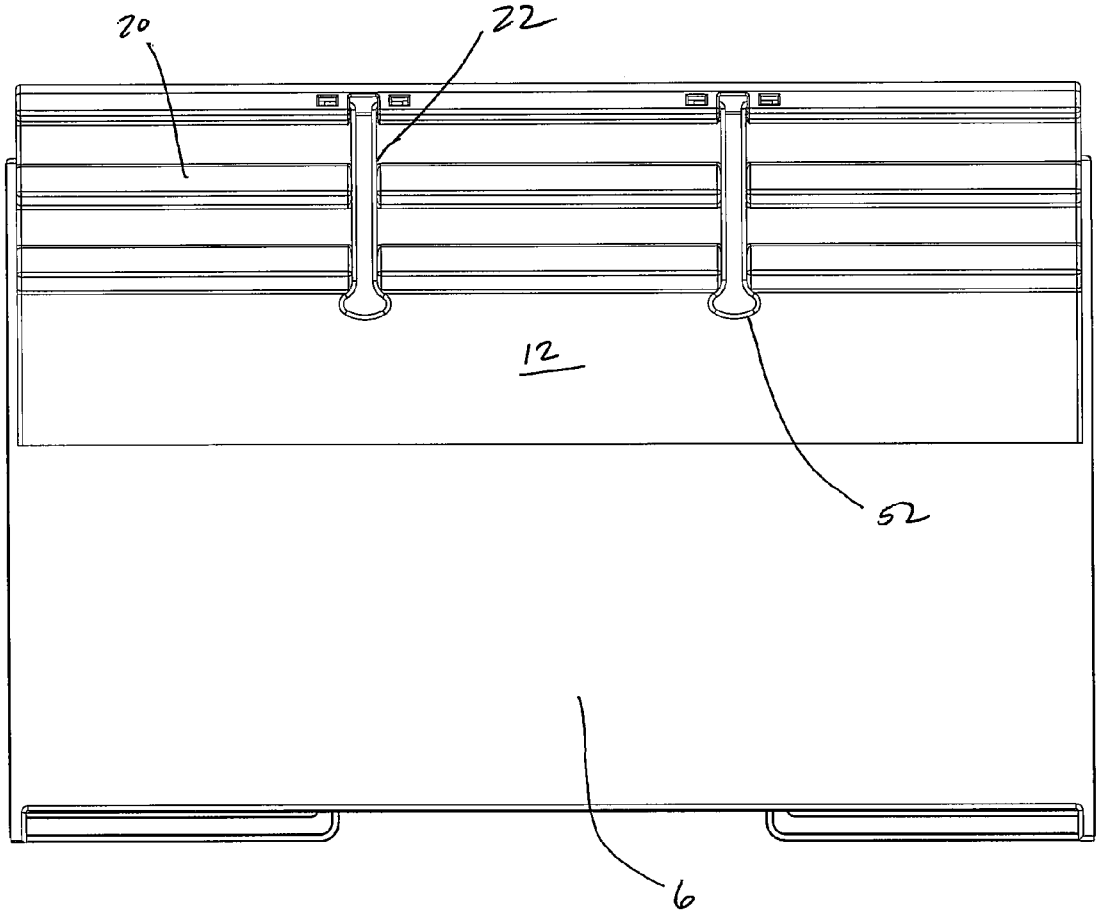
FIG. 13 is a rear elevation view of FIG. 11.

Referring now to FIGS. 8 and 9, a bottom plan view is shown wherein the stabilizer 56 in a first, retracted position of use. Here, the profile of stabilizer 56 is generally similar to that of the bottom panel 48. The stabilizer 56 is held in place via the tab 84 that resides in the slot 60 of the stabilizer 56. The stabilizer 56 of one embodiment includes at least one raised member 96 that selectively engages a recess 100 in the bottom panel 48. The engagement between raised member 96 and recess 100 allows the stabilizer 56 and the bottom panel 48 to be locked relative to each other.

FIG. 9 shows the stabilizer 56 in a second, extended position of use wherein the tabs 84 are positioned at one end of the slot 60. Some embodiments include a grasping member 104 i.e., a protruding surface of a stabilizer 56, that interacts with a raised member 108 of the bottom panel 48 that also helps maintain the stabilizer 56 in a locked configuration as shown in FIG. 8. The grasping member 104 allows for an individual to easily move the stabilizer 56 from the first position of use to the second position of use. The stabilizer 56 is also operably secured by a lip 112 associated with the bottom portion of the left and right panels and walls. The lip 112 acts as a track that allows free movement of the stabilizer 56 while keeping it adjacent to the bottom panel 48.

Figure 14:
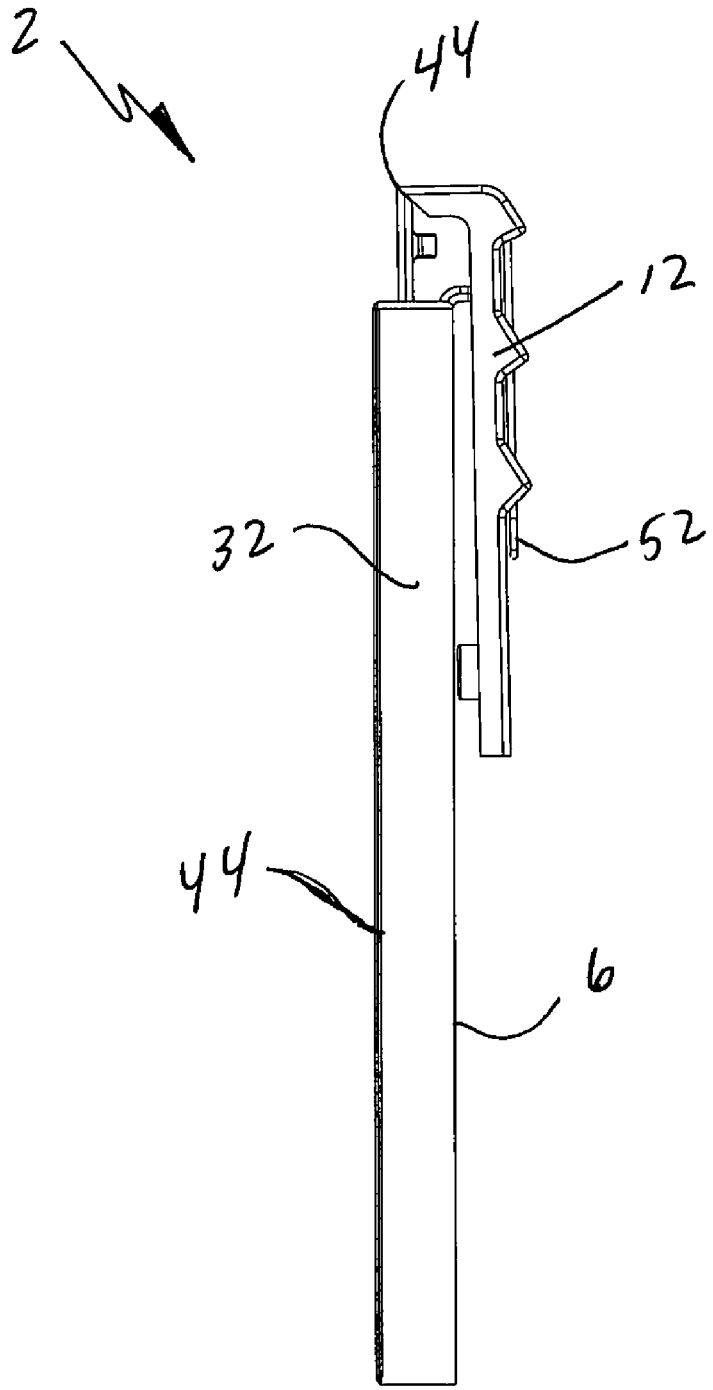
FIG. 14 is a side elevation view of FIG. 11.
Figure 15:
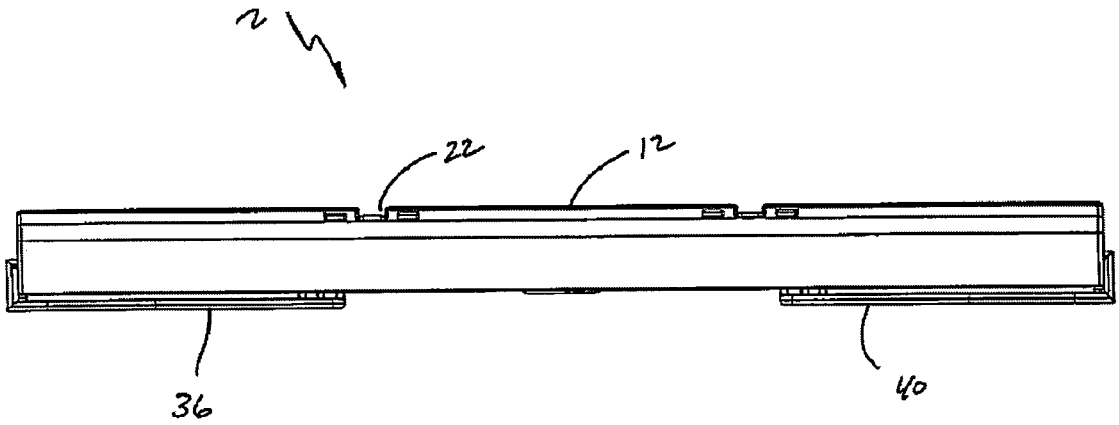
FIG. 15 is a top plan view of FIG. 11.

Referring now to FIGS. 10-15, the collapsible nature of one embodiment of the present invention is illustrated. In operation, the book rest 2 is collapsed by rotating the left panel 36 and the right panel 40 outwardly relative to their respective walls. Rotation of the panels allows the fasteners 76 to be removed from the edge 80 of the front panel 8. Rotation of the left and right panels also removes the front panel 8 and the bottom panel 48 from the slot 116 provided between the two adjacent tracks 68 located on each of the left panel 36 and the right panel 40. The interconnected front panel 8 and the bottom the bottom panel 48 is then transitioned upwardly towards the rear panel 6. The bottom panel 48 and the rear panel 6 are interconnected via a hinge 120, which is, preferably, a piano hinge. One skilled in the art will appreciate other types of hinges may be employed effectively well such as a living hinge. Once the front panel 8 and the rear panel 48 are folded to a position adjacent to the rear panel 6, the top panel 12 is folded to a location adjacent to the outside portion of the rear panel 6 as seen in FIG. 14. Finally, the left panel 36 and the right panel 40 are folded over the front panel 8 and the bottom panel 48 to provide a low profile folded configuration. Some embodiments of the present invention provide mechanisms that maintain the left panel 36 and the right panel 40 in the folded position, such as hook & loop fasteners, clips, magnets, etc. In one embodiment of the present invention, the folded dimension of the book rest 2 is about 1.25 inches, which renders the book rest ideally suited for storage in a brief case or attaché, for example. Further, one embodiment of the present invention that is constructed of polystyrene weights about 1.5 lbs.

Referring again to FIGS. 1-15, the collapsible embodiment of the present invention is made of rigid or semi-rigid materials, such as plastic (preferably blow molded, injection molded, thermoformed, vacuum formed, etc.). However, one skilled in the art will appreciate other materials, such as metal, wood, cardboard, etc. may be used without departing from the scope of the invention. It is also contemplated that the surfaces be adapted to receive a plurality of indicia and/or colors. In one embodiment of the present invention, the left panel 36, left wall 28, rear panel 6 and the right wall 32 and the right panel 40 are made of a single piece of material (i.e., a first subassembly) that is molded or subsequently formed to define the walls and panels as shown in the figures. Similarly, the top panel 12, front panel 8 and bottom panel 48 may be fabricated as a single component (i.e., a second subassembly). Further, all of the panels may be made from a single mold or as a unitary component. Preferably, the two sub-assemblies are operably interconnected via a piano hinge 120, wherein a bottom wall 178 of the rear panel 6 is selectively interconnected to said bottom panel 48. The stabilizer 56 is integrated onto the bottom panel 48 via the slot/tab configuration described above. One skilled in the art will appreciate that the stabilizer may be completely removable and interconnected to the book rest 2 via magnets, snaps, hook and loop fasteners, adhesives, etc.

Figure 16:
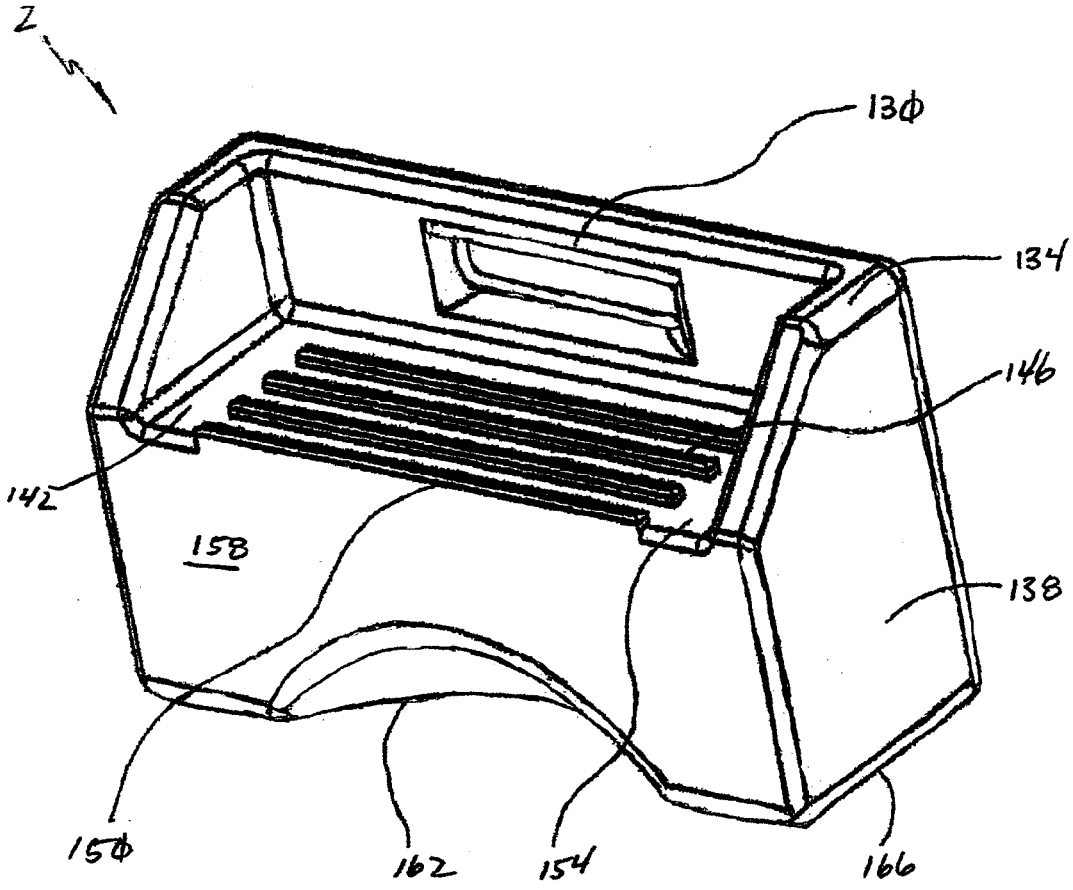
FIG. 16 is a perspective view of a book rest of another embodiment of the present invention that is not collapsible.
Figure 17:
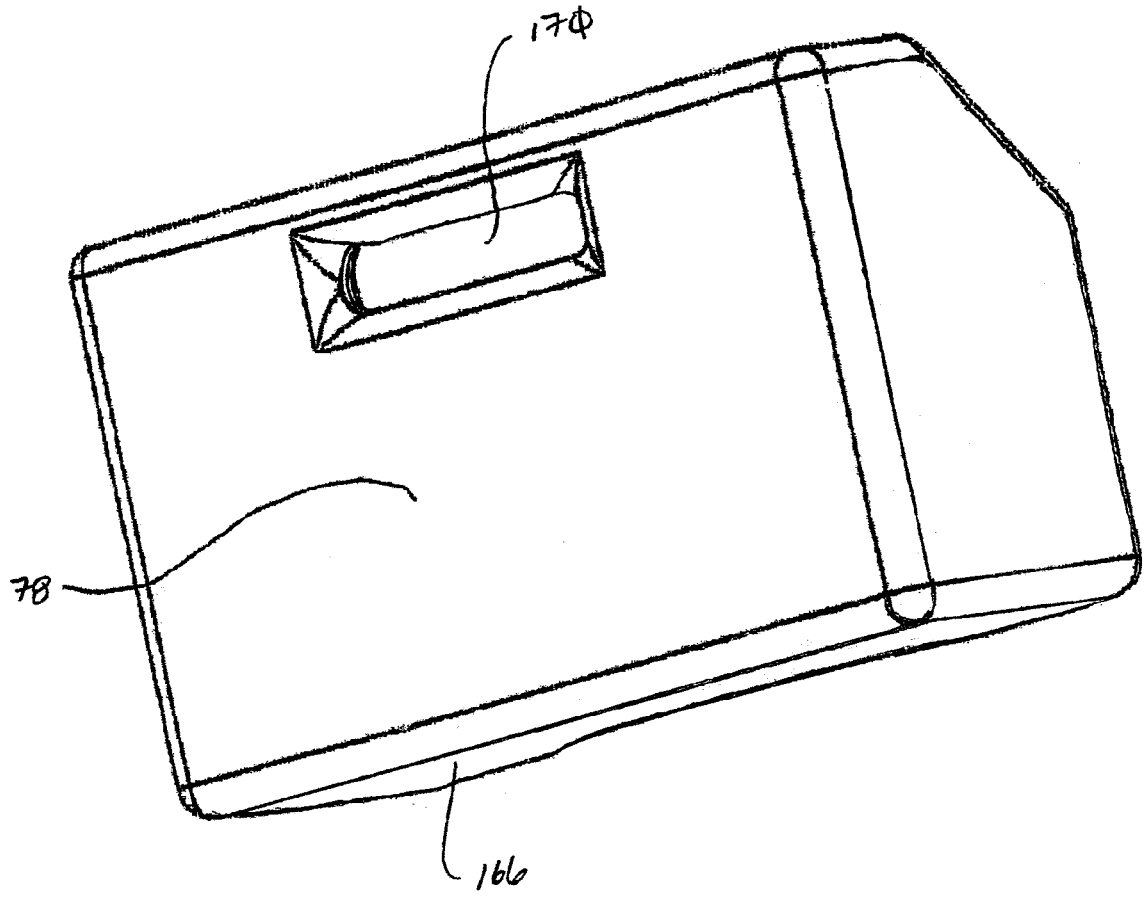
FIG. 17 is a rear perspective view of FIG. 17.
Figure 18:
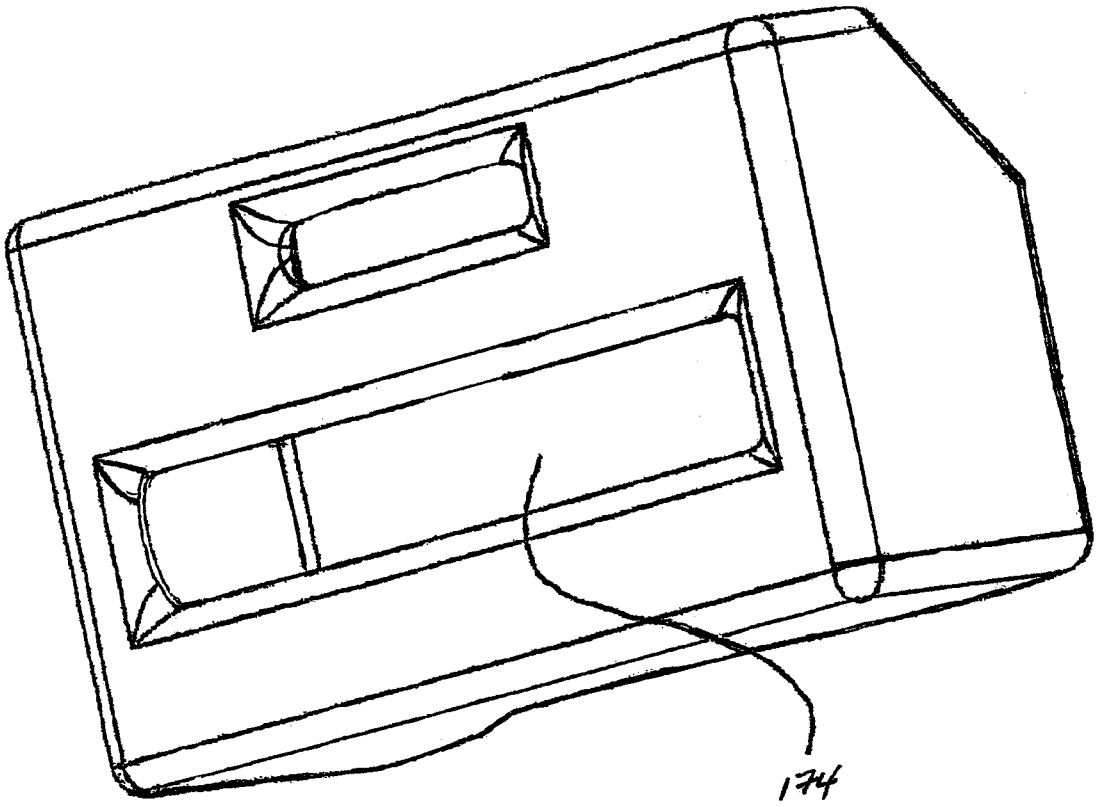
FIG. 18 is a rear perspective view similar to that of FIG. 17 wherein a storage area is provided within the book rest.

Referring now to FIGS. 16-18, another embodiment of the present invention is shown that is preferably formed of a solid or semi-solid piece of material such as foam, i.e., Styrofoam, EVA foam, fixed foam, expanded polystyrene, etc. The foam may be spray coated with a plastic or rubber, for example. The book rest 2 includes a book support 130 bounded by an edge 134 of a sidewall 138. A top surface 142 is also shown that includes a plurality of ribs 146 to support a book as described above. The top surface 142 also may include a ledge 150 to prevent the supported book from sliding from the top surface 142. Some embodiments of the present invention also include a palm rest 154. A front panel 158 of the book rest 2 of this embodiment of the present invention also includes a recess 162 to accommodate the user's abdomen. Preferably, a solid base 166 is provided which is adapted to rest on a user's legs. Some embodiments of the present invention include a handle 170 to facilitate moving the book rest. One related embodiment of the present invention includes a hollow portion that provides a storage area 174 for books, electronic devices, snacks, CDs, DVDs, etc. The storage area 174 may be accessible through the rear surface 178 of the book rest 2 and may include a slidable door or other closure mechanism to prevent stored items from falling out of the book rest 2 while in transport.

Those skilled in the art will appreciate that additional mechanisms may be incorporated into the book rest 2 of this embodiment of the present invention. For example, telescoping legs or other mechanisms that selectively slide from the base 166 of the book rest 2 may be incorporated to provide additional height adjustments to the book rest. The legs of one embodiment of the present invention are posts that are selectively moved with respect to the base 166 to selectively angle and/or position the book. For example, the rear legs may be extended less than the front legs, thereby altering the angle of the top surface 142 of the book rest 2. It is also contemplated that the entire base 166 or legs, if applicable, be of a telescoping nested nature such as to provide selective height adjustments. Those skilled in the art will appreciate such height adjustments render the book rest ideal for use as a podium for business presentations or for a cookbook, for example.

The edge 134 of the book rest may also include a built in light that is adapted to shine onto the pages of the secured book. For example, a light may be selectively incorporated into the edge such that action by the user would extend the light to place the light in a position for illuminating the page.

The upper edge of the rear surface may also include a protrusion as shown in FIG. 1 to support a larger book, writing tablet or computer as described above.

This embodiment of the present invention is preferably constructed of coated foam as described above, which is easily moldable and/or modifiable. The surfaces of the embodiment of the invention shown may also include indicia and/or colors. Cushions may also be added to increase comfort to the user.

Referring now to FIGS. 1-18, embodiments of the present invention are used by individuals who, by means of medical necessity, for example, require a supporting device for their reading materials. The user places the book rest with the base or bottom panel on his/her legs with the front panel positioned adjacent to their abdomen. The openings or recesses provided by embodiments of the present invention accommodate muscle atrophy or individuals with larger abdomens. The book would then be placed on the top surface of the book rest with a portion thereof resting against the upper edge of the rear panel. The bottom edge of the book is placed in a position between the ridges or ribs to selectively position the book at the desired angle. In some instances a stabilizer would be needed and deployed to increase the surface area of the base to provide further stability to the book rest.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A collapsible book rest, comprising:

a rear panel having a left wall, a right wall and a bottom wall, said rear panel including a first track and a second track with a first slot therebetween;

a left panel operably interconnected to said left wall, the left panel having a third track and a forth track with a second slot therebetween positioned adjacent to a front edge and a bottom edge of said left panel;

a right panel operably interconnected to said right wall, the right panel having a fifth track and a sixth track with a third slot therebetween positioned adjacent to a front edge and a bottom edge of said right panel;

a bottom panel;

a front panel operably interconnected to said bottom panel;

a top panel with a ridge extending therefrom;

wherein said top panel has a first position of use wherein a rear edge thereof is situated in said first slot, a left edge of said front panel and bottom panel are situated in said second slot, and a right edge of the front panel and bottom panel are situated in said third slot; and wherein said top panel has a second position of use wherein a bottom surface of said top panel is located adjacent to said rear panel, said bottom panel and said front panel are located adjacent to said rear panel, and said left panel and said right panel are folded over said front panel and said bottom panel.

2. The device of claim 1, wherein said left panel is interconnected to said left wall by way of a living hinge, said right panel is interconnected to said right wall by way of a living hinge, said front panel and said bottom panel are interconnected by way of a living hinge.

3. The device of claim 1, wherein said bottom panel is interconnected to said bottom wall by way of a piano hinge.

4. The device of claim 1, wherein said left panel and said right panel include a left ledge and a right ledge, respectively, that support said top panel in said first position of use.

5. The device of claim 1, wherein said left panel and said right panel includes a plurality of fasteners that receive and secure a portion of said front panel.

6. The device of claim 1, further comprising a stabilizer operably interconnected to said bottom panel, said stabilizer having a first, retracted position of use and a second, extended position of use.

7. The device of claim 1, wherein each of said left panel and said right panel includes at least one opening.

8. The device of claim 1, further including at least one page holder rotatably interconnected to said top panel.

9. The device of claim 8, wherein said at least one page holder is spring biased.

10. The device of claim 1, wherein at least one of said front panel and said bottom panel includes a recess.

* * * * *